US007047851B2

(12) United States Patent
Waisath

(10) Patent No.: US 7,047,851 B2
(45) Date of Patent: May 23, 2006

(54) WICK TRIMMER

(75) Inventor: Curt D. Waisath, Mesa, AZ (US)

(73) Assignee: CleanCut, L.L.C., Salt Lake City, UT (US)

( * ) Notice: Subject to any disclaimer, the term of this patent is extended or adjusted under 35 U.S.C. 154(b) by 0 days.

(21) Appl. No.: 10/782,103

(22) Filed: Feb. 19, 2004

(65) Prior Publication Data

US 2005/0186523 A1 Aug. 25, 2005

(51) Int. Cl.
*B26B 13/00* (2006.01)

(52) U.S. Cl. ..... 83/13; 30/131; 30/233; 30/179

(58) Field of Classification Search ..... 30/131, 30/179, 233, 254, 257, 259, 286; 431/120; D8/57

See application file for complete search history.

(56) References Cited

U.S. PATENT DOCUMENTS 2,117,224 A * 5/1938 Soss ..... 30/229
2,136,414 A * 11/1938 Clements ..... 606/174
2,994,321 A * 8/1961 Tischler ..... 600/564
D422,470 S 4/2000 Mosca et al.
6,243,954 B1 * 6/2001 Bowers ..... 30/233
6,321,453 B1 * 11/2001 Pappas ..... 30/179
D454,291 S * 3/2002 Mosca ..... D8/57
D458,100 S * 6/2002 Bowers ..... D87/57
6,405,441 B1 * 6/2002 Rucker ..... 30/179
D464,243 S * 10/2002 Mosca ..... D8/57
2003/0172533 A1 * 9/2003 Alexander ..... 30/131
2004/0166452 A1 * 8/2004 McInnis ..... 431/120

* cited by examiner

*Primary Examiner*—Hwei-Siu Payer
(74) *Attorney, Agent, or Firm*—Kirton & McConkie; Dale E. Hulse; David B. Tingey

(57) ABSTRACT

A wick trimmer apparatus is herein provided and more particularly, a wick trimmer with a measuring foot that facilitates the effective cutting of a wick to an appropriate length. The wick trimmer has two arms and a measuring foot connected to the second arm that determines the length of a wick protruding from the top portion of a candle. The wick trimmer also has a debris tray formed from a top portion of the measuring foot and a top portion of a base of the first arm. The angles of the arms facilitate both the effective trimming of wicks and the ability of the wick trimmer to access a candle housed within a narrow candle container.

29 Claims, 7 Drawing Sheets

WICK TRIMMER

BACKGROUND OF THE INVENTION

1. Field of the Invention

The present invention relates to a wick trimmer. More particularly, the present invention relates to a wick trimmer with a measuring foot that facilitates the effective cutting of a wick to an appropriate length.

2. Background and Related Art

Wick trimmers are often used in order to shorten a wick to an appropriate length.

Sometimes wicks need to be shortened because candles are sold with wicks that are too long or because candle wicks become too long after a period of burning. Failing to trim wicks to an appropriate length can result in a fire hazard.

However, achieving a proper wick trim can be problematic. Existing wick trimmers fail to accurately or easily measure an appropriate wick length. This is because they either rely on the human eye to judge the appropriate wick length or because they are difficult to negotiate.

Many existing wick cutters also fail to effectively cut through wicks. Wicks consist of a metal filament that presents difficulties for many wick cutters that are either unsharpened or not sturdy enough to create clean wick cuts.

In addition, many wick cutters do not fit into some designs of candle holders. For instance, wick cutters with scissor-like designs do not fit into narrow candle holders.

Also, many wick cutters fail to catch the wick after it is cut, leaving a candle cluttered with old wick pieces.

SUMMARY OF THE INVENTION

The present invention relates to a novel wick trimmer. More particularly, the present invention relates to a wick trimmer with a measuring foot that facilitates the effective cutting of a wick to an appropriate length.

Implementation of the present invention takes place in association with a candle, a wick and a wick trimmer. In one implementation, the wick trimmer cuts a wick to a predetermined length. This increases the safety of candle usage by decreasing the fire hazard caused by a long wick. Where multiple-wicks are presented near each other, such as in multi-wick candles or a set of candles, the uniformity of wick length also creates a more aesthetically pleasing appearance.

In another implementation, the measuring foot has a uniform thickness. The thickness of the measuring foot facilitates the effectiveness of the cuts produced by the wick trimmer.

In a related implementation, the measuring foot has a cutting edge, which when combined with the thickness of the measuring foot, produces effective, clean cuts on all parts of the cutting edge.

In yet another implementation, the measuring foot has a debris tray formed on the top portion of the measuring foot. The debris tray catches the wick after it is cut, leaving the candle uncluttered by old wick pieces.

In another implementation, the wick trimmer comprises two arms that are connected together. Variable cutting strength is created along the cutting edge because the angles of the arms are slightly different. In a related implementation, the angles of the arms allow the wick trimmer to access the wicks of candles that are housed in candle holders with very narrow openings.

In another implementation, the middle portion of both arms is angled to a degree that facilitates the overlap and attachment of both arms onto each other.

In another implementation, the wick trimmer is made out of stainless steel.

In another implementation, the cutting edge is serrated.

While the methods and processes of the present invention have proven to be particularly useful in the area of wick trimming, those skilled in the art can appreciate that the methods and processes can be used in a variety of different applications and in a variety of different areas of manufacture to yield effective trimming results.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to a wick trimmer. More particularly, the present invention relates to a wick trimmer with a measuring foot that facilitates the effective cutting of a wick to an appropriate length.

Figure 1:
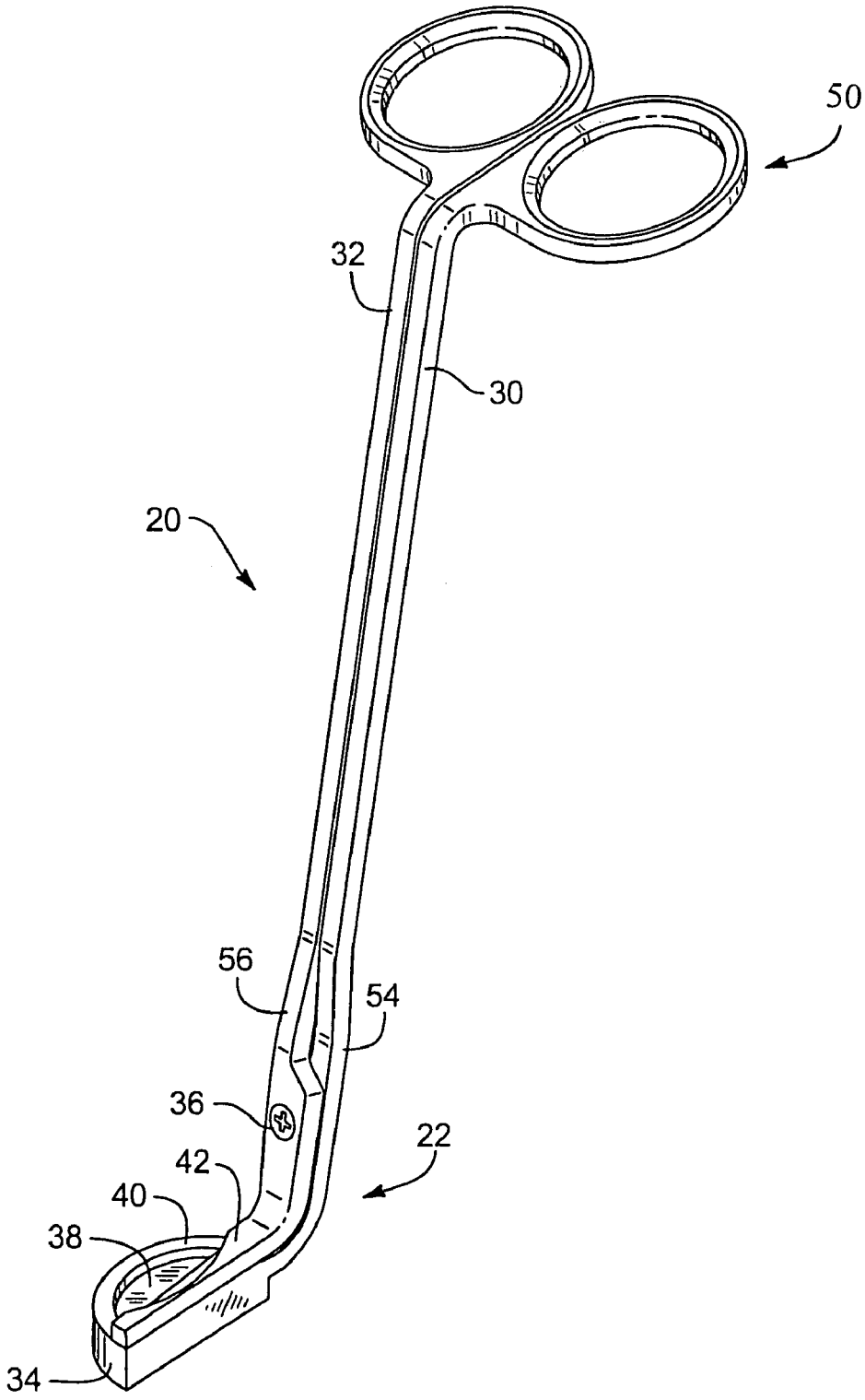
FIG. 1 provides an illustration of a representative embodiment of the present invention, wherein a wick trimmer is in closed position.

FIG. 1 provides an illustration of a representative embodiment of the present invention, wherein a wick trimmer 20 is in a closed position 22 that includes a first cutting arm 30, a second cutting arm 32, a measuring foot 34, a pin 36, and a debris tray 38. In this embodiment, the measuring foot 34, which is also referred to as a base or an end, has a uniform thickness of about ¼". This thickness is the most presently preferred thickness of the preferred embodiment. However, other presently preferred embodiments not shown in FIG. 1 have a thickness of between about ⅛" and about ⅞" or more preferably, a thickness of between about ⅛" and about ½".

In some embodiments, the thickness is uniform and in others it is not. These thicknesses, combined with the sturdy, stainless steel material out of which the wick cutter is made, facilitate a clean, consistent cut of the wick.

As can be seen in FIG. 1, the debris tray 38 is formed from a top rim portion 40 of the measuring foot 34 and a base 42 of the second cutting arm 32. When the wick trimmer is in the closed position 22, as is shown in FIG. 1, a trimmed portion of a wick sits within the debris tray 38 and can be easily removed from a candle or a candle container. Also shown in this embodiment of the present invention are handles 50, which aid a user in manipulating the wick trimmer 20.

In addition, FIG. 1 shows a middle portion 54 of the first cutting arm 30 and a middle portion 56 of the second cutting arm 32 that are both angled. The angular configuration allows the first cutting arm 30 and the second cutting arm 32 to overlap such that pin 36 can securely couple the first cutting arm 30 and the second cutting arm 32. In some embodiments, a middle portion of the first cutting arm is angled between about 170° and about 175° and a middle portion of the second cutting arm is angled between about 170° and about 175°, allowing the first cutting arm and the second cutting arm to overlap so that the first cutting arm and the second cutting arm can connect.

Figure 2:
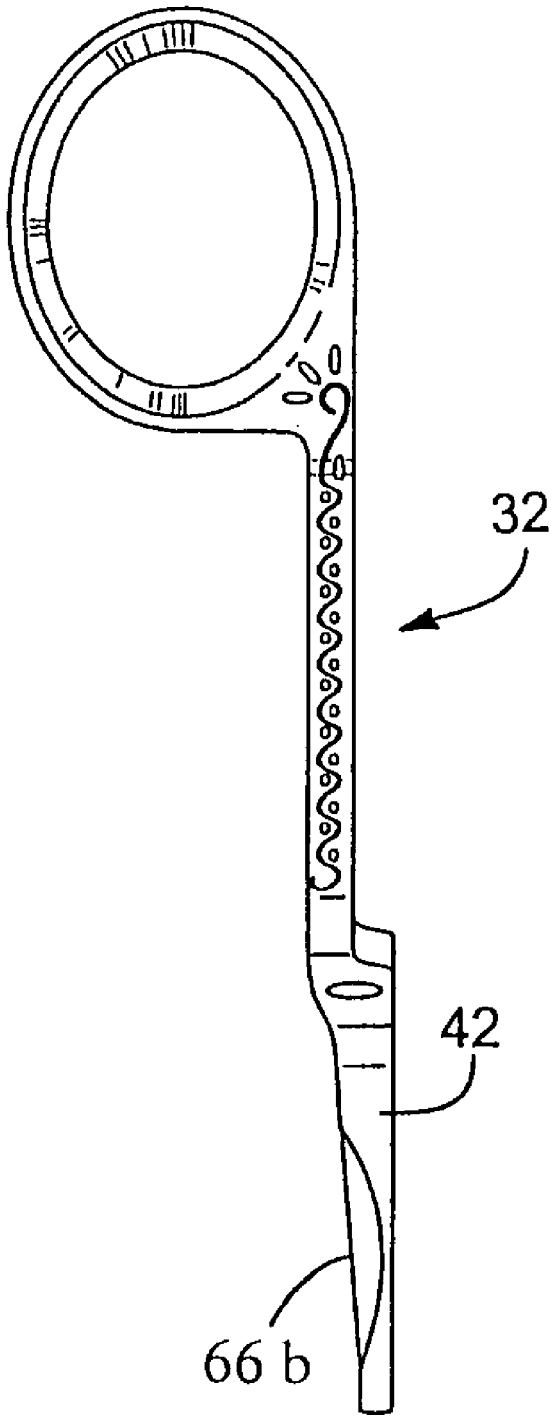
FIG. 2 illustrates a top view of the second cutting arm.

FIG. 2 shows a top view of the second cutting arm 32. This view highlights base 42 of the first cutting arm 32 that forms the debris tray 38 (FIG. 1) when the wick trimmer 20 is in the closed position 22.

Figure 3:
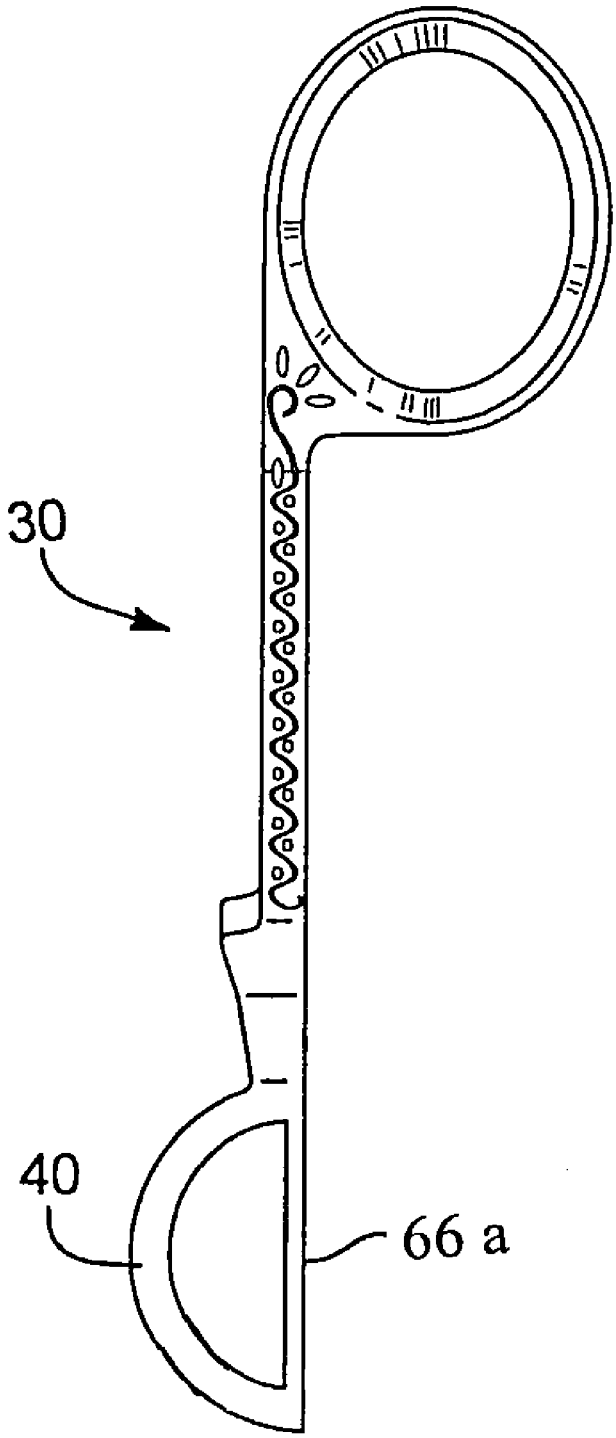
FIG. 3 illustrates a top view of the first cutting arm.

FIG. 3 shows a top view of the first cutting arm 30. This view highlights the top portion of the measuring foot 40 that forms the debris tray 38 (FIG. 1) when the wick trimmer 20 is in the closed position 22.

Figure 4:
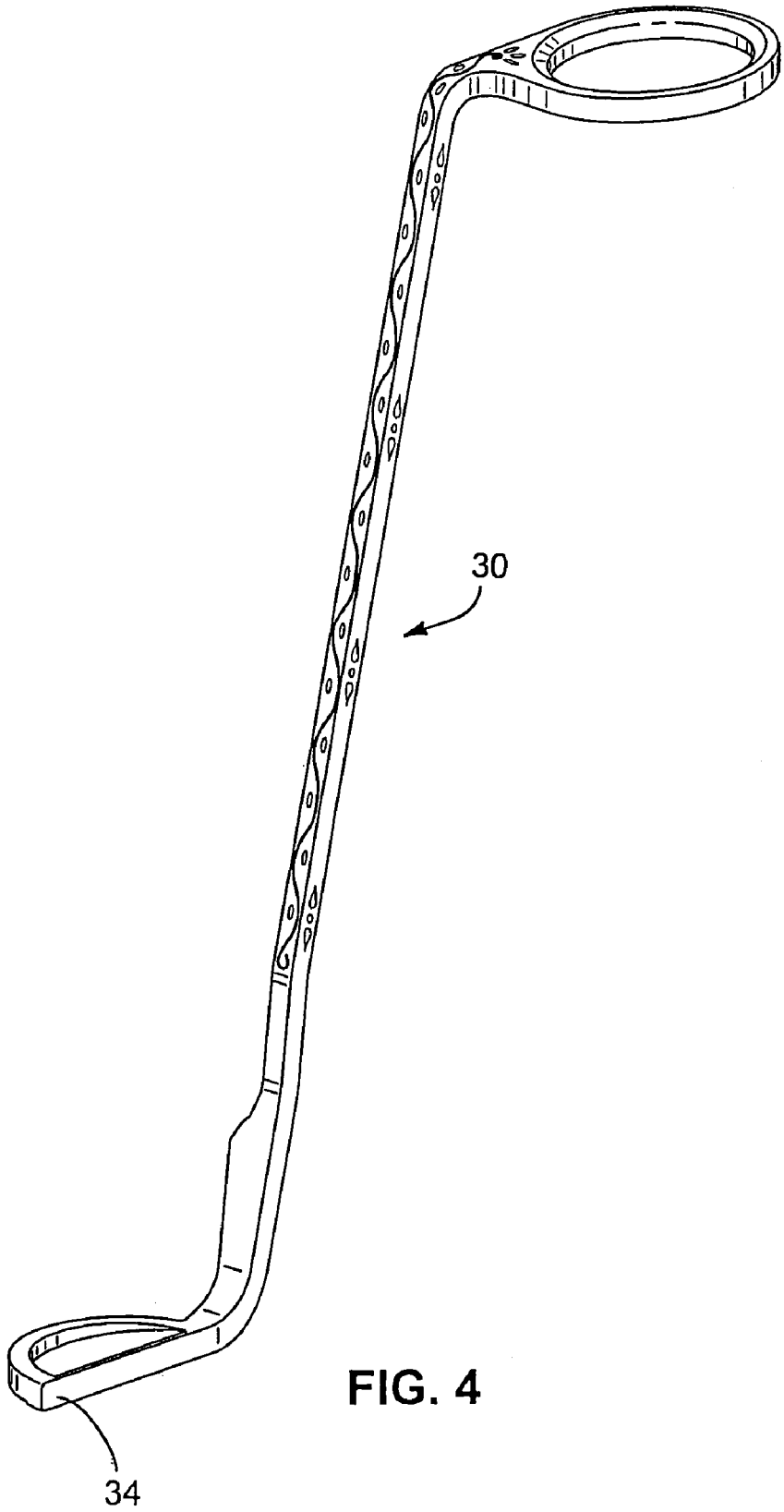
FIG. 4 illustrates an alternative view of the first cutting arm.

FIG. 4 shows an alternative view of the first cutting arm 30. This view highlights the thickness of the measuring foot 34.

Figure 5A:
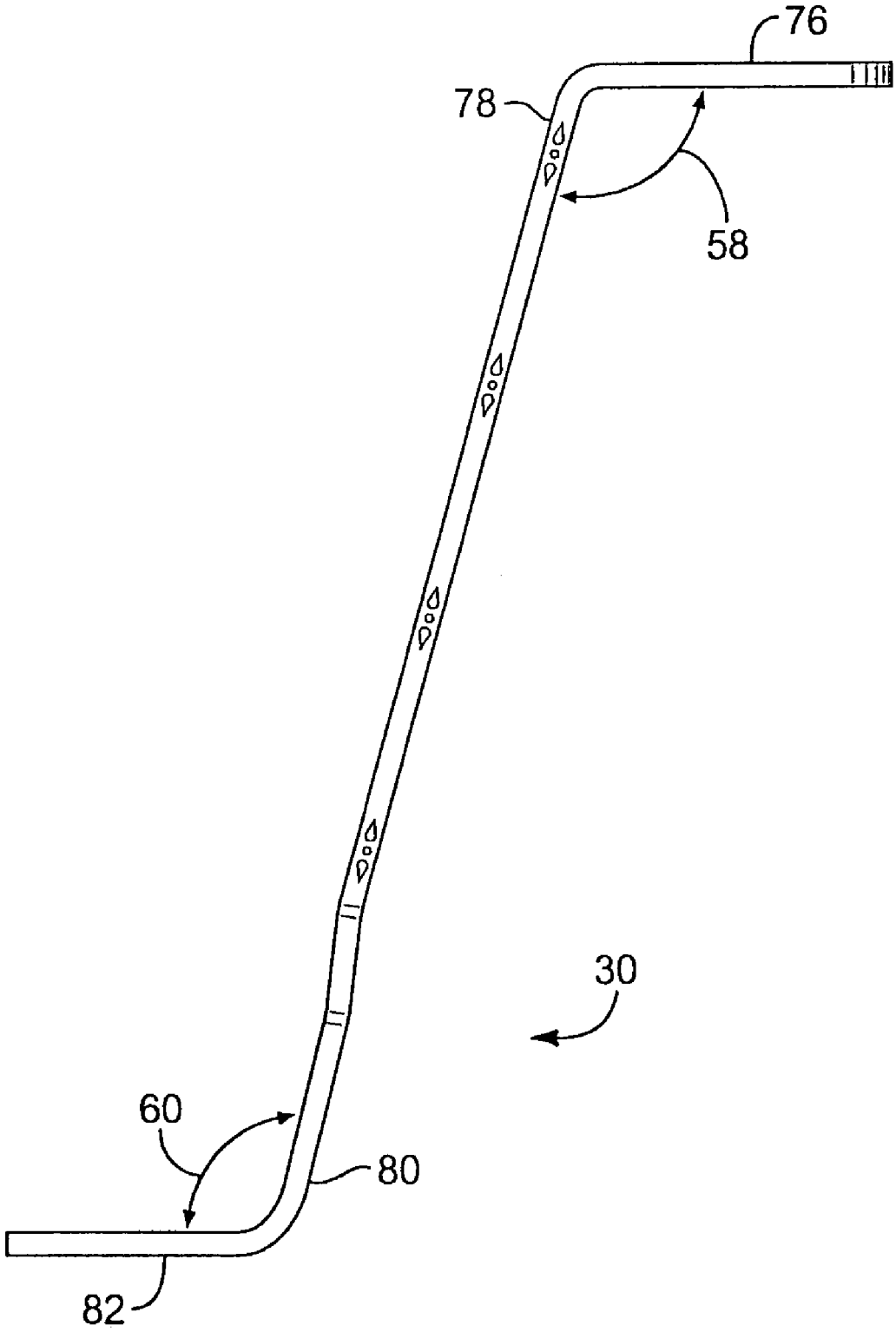
FIG. 5A illustrates a side view of the first cutting arm.

As seen in FIG. 5A, a first portion 76 of the first cutting arm 30 and a second portion 78 of the first cutting arm 30 form a top angle 58 of the first cutting arm 30 and a third portion 80 of the first cutting arm 30 and a fourth portion 82 of the first cutting arm 30 form a bottom angle 60 of the first cutting arm 30. Similarly, in FIG. 5B, a first portion 84 of the second cutting arm 32 and a second portion 86 of the second cutting arm 32 form a top angle 62 of the second cutting arm 32 and a third portion 88 of the second cutting arm 32 and a fourth portion 90 of the second cutting arm 32 form a bottom angle 64 of the second cutting arm 32.

FIG. 5A shows a side view of the first cutting arm 30. This view illustrates an embodiment of the present invention where the top angle 58 of the first cutting arm 30 is different than the bottom angle 60 of the first cutting arm 30. In this particular, non-limiting example, the top angle 58 of the first cutting arm 30 is about 105.00°, and the bottom angle 60 of the first cutting arm 30 is about 105.75°. In some embodiments, the first cutting arm includes a top angle and a bottom angle of between about 95.00° and about 115.00°.

Figure 5B:
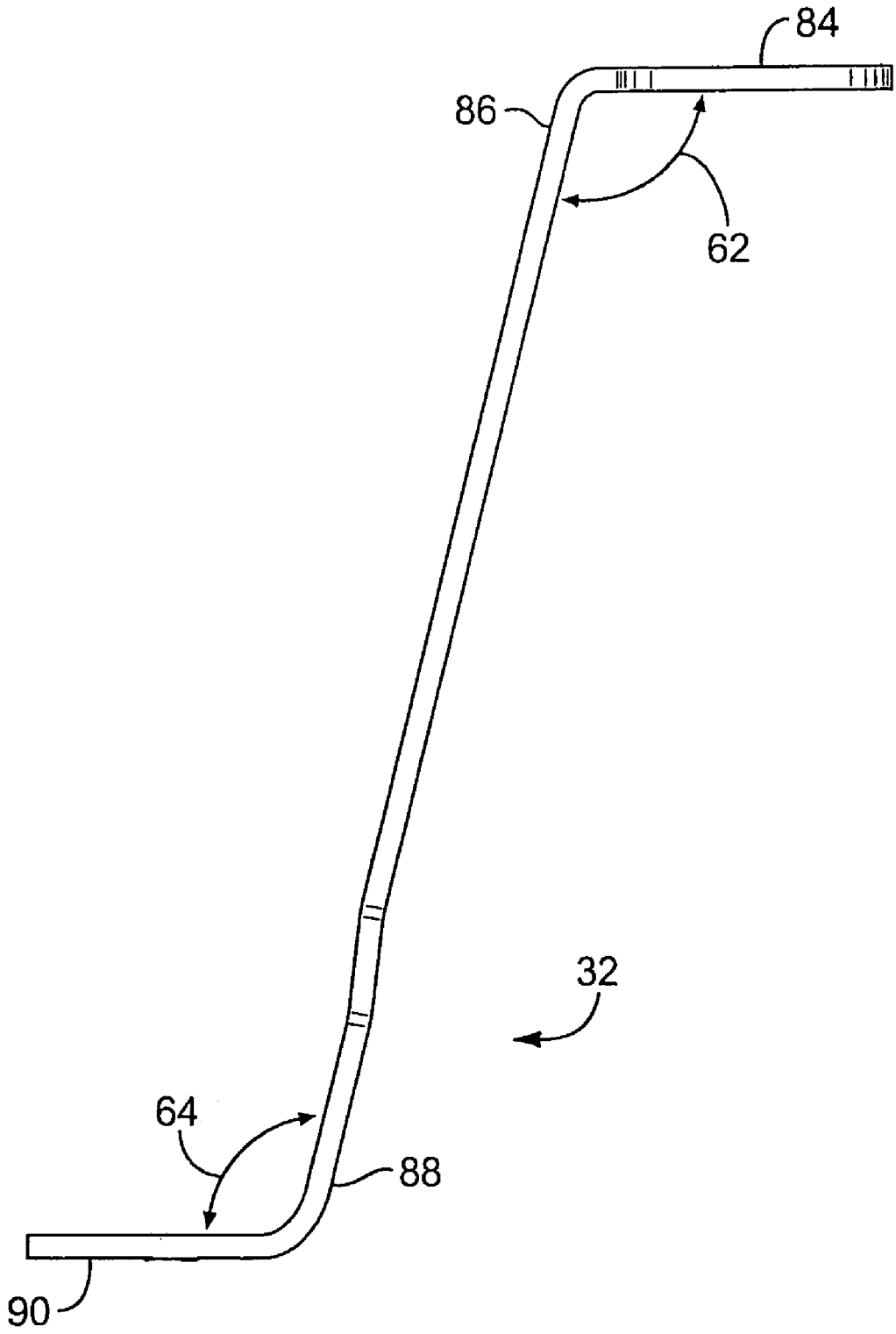
FIG. 5B illustrates a side view of the second cutting arm.

FIG. 5B shows a side view of the second cutting arm 32. This view illustrates an embodiment of the present invention where the top angle 62 of the second cutting arm 32 is the same as the bottom angle 64 of the second cutting arm 32. In this particular, non-limiting example, the top angle 62 of the second cutting arm 32 and the bottom angle 64 of the second cutting arm 32 are both about 105.00°. In some embodiments, the second cutting arm includes a top angle of between about 95.00° and about 115.00° and a bottom angle at least about 0.25° greater than the top angle.

Thus, when the first cutting arm 30 and the second cutting arm 32 of FIGS. 5A and 5B are coupled together, variable cutting strength is created along a cutting edge 66 (FIGS. 2–3) because of the difference in angles between the bottom angle 60 of the first cutting arm 30 and the bottom angle 64 of the second cutting arm 32. This embodiment shows that the most presently preferred difference in angle between the bottom angle 64 of the second cutting arm 32 and the bottom angle 60 of the first cutting arm 30 about 0.75°. In other presently preferred embodiments, this difference is between about 0.25° and about 1.25°, more preferably between about 0.35° and about 1.15° and, most preferably between about 0.50° and about 1.00°. This variable cutting strength in part contributes to the surprisingly successful cutting results of the wick trimmer 20, when compared against other wick cutters.

In addition, in other embodiments, a top angle 58 of the first cutting arm 30 and a top angle 62 of the second cutting arm 32 have a range of between about 100° and about 110°.

Figure 6:
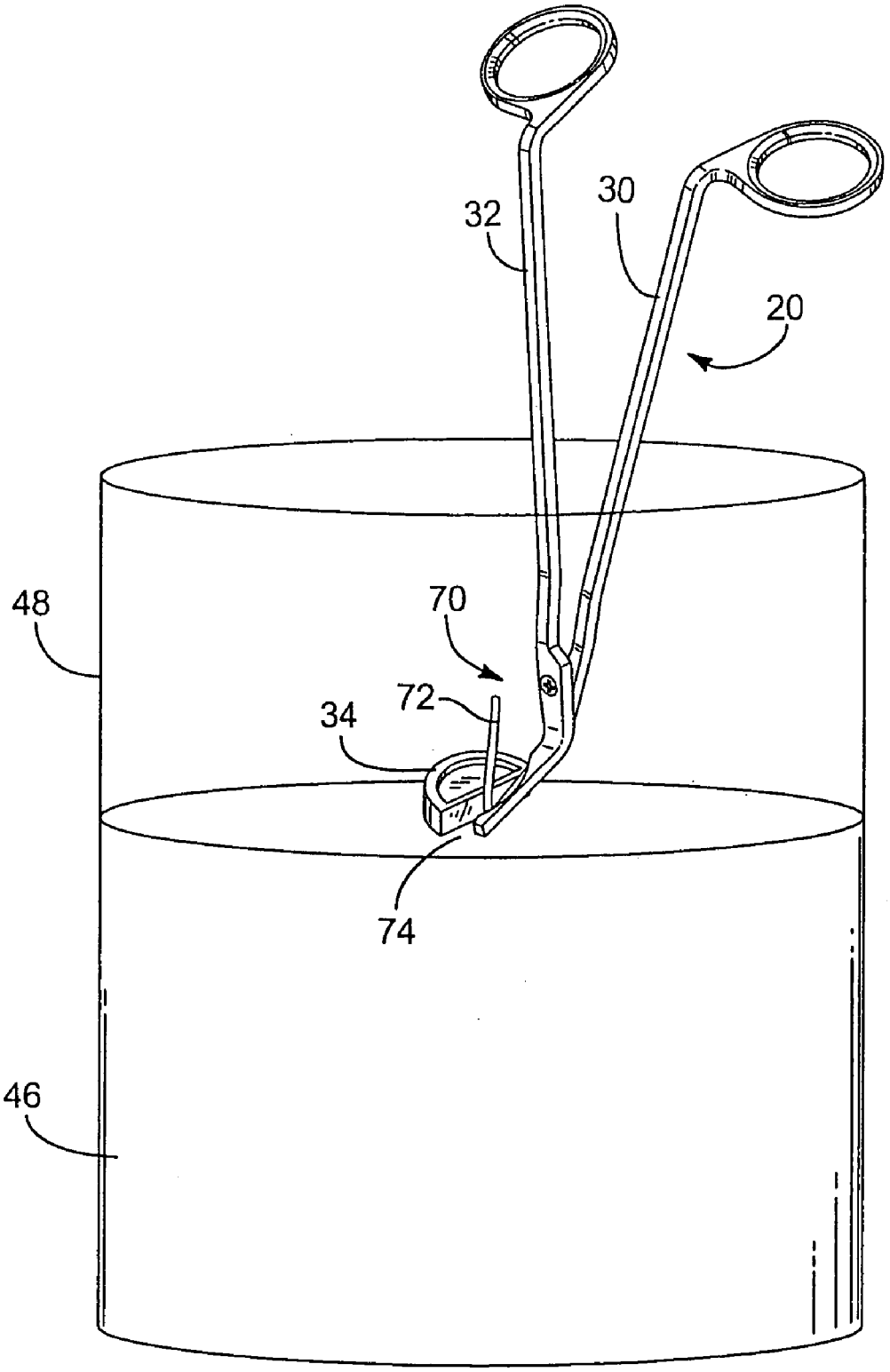
FIG. 6 provides an illustration of a representative embodiment of the present invention, wherein the wick trimmer is in an open position and is also shown along with a candle, candle container and wick.

FIG. 6 provides an illustration of a representative embodiment of the present invention, wherein the wick trimmer 20 is in an open position 70. This embodiment also shows candle 46, candle container 48 and wick 72. This embodiment shows how the first cutting arm 30 and the second cutting arm 32 allow the wick trimmer 20 to fit within candle container 48. It also illustrates how measuring foot 34 is placed against a top surface 74 of candle 46 in order to accurately measure the length of the wick 72 that should remain after trimming. In one embodiment, the wick trimmer is configured so as to fit into a candle container that is at least about 1.5 inches in diameter.

Thus, as discussed herein, the embodiments of the present invention embrace the field of wick trimmers. More particularly, the present invention relates to a wick trimmer with a measuring foot that facilitates the effective cutting of a wick to an appropriate length.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method for trimming a wick to a pre-determined length comprising:

providing a first cutting arm having a base;

providing a second cutting arm pivotally connected to said first cutting arm, wherein said second cutting arm includes a measuring foot having a thickness that is greater than a thickness of said base, wherein said measuring foot thickness determines the length of a wick allowed to remain above a top surface of a candle upon trimming the wick;

placing a wick of a candle between the base and measuring foot;

placing a bottom surface of the measuring foot on the top surface of the candle;

moving said first and second cutting arms to a closed position;

cutting the wick to a height that corresponds to the measuring foot thickness such that the cut wick stands underneath a bottom surface of the base when the bottom surface of the measuring foot is contacting the top surface of the candle; and receiving at a debris tray any portion cut from the wick, wherein the debris tray comprises said measuring foot, a top rim of measuring foot, and said base.

2. The method of claim 1, further comprising the step providing variable cutting strength that is created by a difference in angle of between about 0.25° and about 1.25° between a bottom angle of said first cutting arm and a bottom angle of said second cutting arm.

3. A wick trimmer comprising:

a first cutting arm having a base;

a second cutting arm pivotally connected to said first cutting arm, wherein said second cutting arm includes a measuring foot having a thickness that is greater than a thickness of said base, wherein said measuring foot thickness determines the length of a wick allowed to remain above the top surface of a candle upon trimming the wick, and wherein a top surface of said measuring foot includes a cutting edge; and a debris tray configured to received any portion off the wick, wherein the debris tray comprises said measuring foot, a top rim of said measuring foot, and said base.

4. The wick trimmer of claim 3, wherein said measuring foot thickness is between about ⅛" and about ⅞".

5. The wick trimmer of claim 3, wherein said base comprises a cutting edge.

6. The wick trimmer of claim 3, wherein said first and second cutting arms are configured so as to create variable cutting strength along said cutting edge as said first cutting arm and said second cutting arm are directed to a closed position.

7. The wick trimmer of claim 6, wherein said variable cutting strength is created by a difference in angle of between about 0.25° and about 1.25° between a bottom angle of said first cutting arm and a bottom angle of said second cutting arm.

8. The wick trimmer of claim 6, wherein said variable cutting strength is created by a difference in angle of between about 0.50° and about 1.00° between a bottom angle of said first cutting arm and a bottom angle of said second cutting arm.

9. The wick trimmer of claim 6, wherein said variable cutting strength is created by a difference in angle of about 0.75° between a bottom angle of said first cutting arm and a bottom angle of said second cutting arm.

10. The wick trimmer of claim 9, wherein said bottom angle of said first cutting arm is about 105.75° and said bottom angle of said second cutting arm is about 105.00°.

11. The wick trimmer of claim 1, wherein a top angle of said first cutting arm forms an angle of between about 100° and about 110°.

12. The wick trimmer of claim 1, wherein a top angle of said second cutting arm forms an angle of between about 100° and about 110°.

13. The wick trimmer of claim 1, wherein the wick trimmer comprises stainless steel.

14. A wick trimmer comprising:

a first cutting arm coupled to a based;

a second cutting arm coupled to a measuring foot having a thickness that is greater than a thickness of said base, wherein said measuring foot thickness determines a length of a wick allowed to remain above a top surface of a candle upon trimming the wick, wherein said second cutting arm is pivotally connected to said first cutting arm;

a debris tray configured to received any portion trimmed off of the wick, wherein the debris tray comprises said measuring foot, a top rim of said measuring foot, and said base; and a cutting edge formed along said base.

15. The wick trimmer of claim 14, wherein said measuring foot has a thickness of between about ⅛" and about ½".

16. The wick trimmer of claim 14, wherein said measuring foot has a thickness of about ¼".

17. The wick trimmer of claim 14, said first cutting arm having a top angle of between about 95.00° and about 115.00° and a bottom angle at least about 0.25° greater than the top angle.

18. The wick trimmer of claim 14, said second cutting arm having a top angle and a bottom angle of between about 95.00° and about 115.00°.

19. The wick trimmer of claim 14, wherein the difference between a top angle and a bottom angle of said first cutting arm creates variable cutting strength along said cutting edge as said first cutting arm and said second cutting arm are directed to a closed position.

20. The wick trimmer of claim 14, wherein a middle portion of said first cutting arm is angled between about 170° and about 175° and a middle portion of said second cutting arm is angled between about 170° and about 175°, allowing said first cutting arm and said second cutting arm to overlap so that said first cutting arm and said second cutting arm can pivotally connect.

21. The wick trimmer of claim 14, wherein a bottom angle of said first cutting arm is about 105.75° and a bottom angle of said second cutting arm is about 105.00°.

22. The wick trimmer of claim 14, wherein a first end of said first cutting arm forms an angle of between about 100° and about 110°.

23. The wick trimmer of claim 14, wherein a first end of said second cutting arm forms an angle of between about 100° and about 110°.

24. The wick trimmer of claim 14, wherein said wick trimmer is configured so as to fit into a cover of a candle, wherein the cover is at least about 1.5 inches in diameter.

25. The wick trimmer of claim 14, wherein the cutting edge is configured to cut through a wick, regardless of whether the wick has been burned previous to the cut.

26. A wick trimmer comprising:

a first cutting arm having a base; and a second cutting arm pivotally coupled to said first cutting arm, wherein said second cutting arm includes a measuring foot having a thickness that is greater than a thickness of said base, wherein said measuring foot thickness determines the length of a wick allowed to remain above a top surface of a candle upon trimming the wick, and wherein said measuring foot and said base each includes a cutting edge, and wherein said first and second cutting arms are configured so as to create variable cutting strength along said cutting edges as said first cutting arm and said second cutting arm are directed to a closed position; and a debris tray configured to received any portion trimmed off of the wick, wherein the debris tray comprises said measuring foot, a top rim of said measuring foot, and said base.

27. The wick trimmer of claim 26, wherein said variable cutting strength is created by a difference in angle of between about 0.25° and about 1.25° between a bottom angle of said first cutting arm and a bottom angle of said second cutting arm.

28. The wick trimmer of claim 26, wherein said variable cutting strength is created by a difference in angle of between about 0.35° and about 1.15° between a bottom angle of said first cutting arm and a bottom angle of said second cutting arm.

29. The wick trimmer of claim 26, wherein said variable cutting strength is created by a difference in angle of about 0.75 degrees between a bottom angle of said first cutting arm and a bottom angle of said second cutting arm.

* * * * *

UNITED STATES PATENT AND TRADEMARK OFFICE

CERTIFICATE OF CORRECTION

PATENT NO. : 7,047,851 B2
APPLICATION NO. : 10/782103
DATED : May 23, 2006
INVENTOR(S) : Curt D. Waisath It is certified that error appears in the above-identified patent and that said Letters Patent is hereby corrected as shown below:

Column 3, line 27, replace “first” with --second--
Column 4, line 49, replace “first” with --second--
Column 4, line 50, replace “second” with --first--
Column 4, line 51, replace “first” with --second-- and “second” with --first--
Column 4, line 57, replace “and measuring” with --and the measuring--
Column 5, line 3, replace “measuring foot” with --said measuring foot--
Column 5, line 4, replace “step” with --step of--
Column 5, line 7, replace “first” with --second--
Column 5, line 8, replace “second” with --first--
Column 5, line 10, replace “first” with --second--
Column 5, line 11, replace “second” with --first-- and “first” with --second--
Column 5, line 12, replace “second” with --first--
Column 5, line 19, replace “received any portion off the” with --receive any portion trimmed off of the--
Column 5, line 34, replace “first” with --second--
Column 5, line 35, replace “second” with --first--
Column 5, line 39, replace “first” with --second--
Column 5, line 40, replace “second” with --first--
Column 5, line 43, replace “first” with --second--
Column 5, line 44, replace “second” with --first--
Column 5, line 46, replace “first” with --second--
Column 5, line 47, replace “second” with --first--
Column 5, line 48, replace “1” with --3--
Column 5, line 49, replace “first” with --second--
Column 5, line 51, replace “1” with --3--
Column 5, line 52, replace “second” with --first--
Column 5, line 54, replace “1” with --3--
Column 5, line 57, replace “first” with --second-- and “based” with --base--
Column 5, line 58, replace “second” with --first--
Column 6, line 63, replace “second” with --first-- and “first” with --second--
Column 6, line 1, replace “received” with --receive--
Column 6, line 10, replace “first” with --second--
Column 6, line 14, replace “second” with --first--
Column 6, line 18, replace “first” with --second--
Column 6, line 21, replace “first” with --second-- and “second” with --first--
Column 6, line 24, replace “first” with --second--
Column 6, line 25, replace “second” with --first--
Column 6, line 27, replace “first” with --second-- and “second” with --first--
Column 6, line 28, replace “first” with --second-- and “second” with --first--
Column 6, line 31, replace “first” with --second--

UNITED STATES PATENT AND TRADEMARK OFFICE

CERTIFICATE OF CORRECTION

PATENT NO. : 7,047,851 B2
APPLICATION NO. : 10/782103
DATED : May 23, 2006
INVENTOR(S) : Curt D. Waisath It is certified that error appears in the above-identified patent and that said Letters Patent is hereby corrected as shown below:

Column 6, line 32, replace “second” with --first--
Column 6, line 34, replace “first” with --second--
Column 6, line 37, replace “second” with --first--
Column 6, line 46, replace “first” with --second--
Column 6, line 47, replace “second” with --first-- and “first” with --second--
Column 6, line 48, replace “second” with --first--
Column 6, line 59, replace “received” with --receive--
Column 7, line 1, replace “first” with --second--
Column 7, line 2, replace “second” with --first--

Signed and Sealed this

Fourteenth Day of November, 2006

JON W. DUDAS
*Director of the United States Patent and Trademark Office*